US006909352B2

(12) United States Patent
Hobson et al.

(10) Patent No.: US 6,909,352 B2
(45) Date of Patent: Jun. 21, 2005

(54) ENDLESS CORE FOR A MULTIPHASE TRANSFORMER AND A TRANSFORMER INCORPORATING SAME

(75) Inventors: Barry Reginald Hobson, North Lake (AU); Christopher Paull Revill, Warwick (AU); Angelo Paoliello, Sawyer Valley (AU); Eric Roberts Laithwaite, deceased, late of Surrey (GB); by David Bagnall, legal representative, West Sussex (GB)

(73) Assignee: Merlex Corporation Pty Ltd., Perth (AU)

( * ) Notice: Subject to any disclaimer, the term of this patent is extended or adjusted under 35 U.S.C. 154(b) by 302 days.

(21) Appl. No.: 10/063,281

(22) Filed: Apr. 8, 2002

(65) Prior Publication Data

US 2003/0088967 A1 May 15, 2003

Related U.S. Application Data

(63) Continuation-in-part of application No. 09/421,897, filed on Oct. 21, 1999, now abandoned.

(30) Foreign Application Priority Data

Nov. 13, 1998 (AU) ..... PP7124
May 13, 1999 (AU) ..... PQ0358

(51) Int. Cl.[7] ..... H01F 17/06
(52) U.S. Cl. ..... 336/178; 336/212; 336/234
(58) Field of Search ..... 336/83, 170, 178, 336/212–216, 220–222, 234

(56) References Cited

U.S. PATENT DOCUMENTS

| | | | | |
|---|---|---|---|---|
| 3,323,069 A | | 5/1967 | Van De Graaff | |
| 3,413,580 A | | 11/1968 | Gibas | |
| 3,611,224 A | | 10/1971 | Becker | |
| 4,099,066 A | | 7/1978 | Beggs | |
| 5,146,198 A | | 9/1992 | Pollard et al. | |
| 5,177,460 A | * | 1/1993 | Dhyanchand et al. | 336/12 |

FOREIGN PATENT DOCUMENTS

| | | | |
|---|---|---|---|
| AU | 42095/85 A | | 11/1985 |
| DE | 140 502 C | | 5/1967 |
| DE | 43 10 199 A | | 10/1994 |
| DE | 196 04 192 A | | 9/1996 |
| RU | 2082245 C1 | * | 6/1997 |

* cited by examiner

*Primary Examiner*—Tuyen T Nguyen
(74) *Attorney, Agent, or Firm*—McGarry Bair PC

(57) ABSTRACT

A core for a multi-phase transformer includes a body made of two or more rings having a common central axis. Each ring consists of a strip of magnetic permeable material wound about the central axis. The body is provided with a plurality of radially disposed windows, each window being bound by opposed axially extending legs and opposed circumferentially extending branches. The branches of each window are provided in respective axially adjacent rings, so that the branches and legs of each window define a closed magnetic circuit of substantially uniform magnetic permeability through which magnetic flux can circulate about the windows.

26 Claims, 7 Drawing Sheets

ENDLESS CORE FOR A MULTIPHASE TRANSFORMER AND A TRANSFORMER INCORPORATING SAME

CROSS REFERENCE TO RELATED APPLICATIONS

This application is a continuation in part of U.S. application Ser. No. 09/421,897 filed Oct. 21, 1999 now abandoned, which claims the benefit of Australian Application Serial No. PQ0358 filed May 13, 1999 and Australian Application Serial No. PP7124 filed Nov. 13, 1998.

BACKGROUND OF INVENTION

1. Field of the Invention

The present invention relates to an endless core for a multiphase transformer and a transformer incorporating such a core.

2. Description of the Related Art

Multiphase transformers are well known and are used in a variety of applications including for stepping up or stepping down line voltage in power transmission systems, to provide phase shifting, modulation, star-delta converters and general power supplies.

A typical multiphase transformer has a planar core provided with a number of square or rectangular windows each window being bound by upper and lower branches of the core, and on opposite sides by vertical legs forming part of the core. A primary winding is wound through each window, either on a branch or leg of the window. Similarly a secondary winding is wound through each window. Irrespective of the number of phases, if the core has N windows then it will have N+1 vertical legs. This provides an inherent magnetic and therefore electrical imbalance between the phases. This arises because the magnetic flux created by current flow in the primary windings cannot circulate equally about the respective windows because of the additional vertical leg. As a result, assuming each primary phase voltage is of the same magnitude and each secondary winding has the same number of turns, then the secondary outputs cannot be the same. The transformation process is not identical between the phases due to the difference in magnetic paths surrounding each window. In order to produce equalized outputs on the secondary windings, i.e. the same magnitude output on each winding, some of the primary or secondary windings must vary the number of turns to take account of the difference in flux distribution circulating about different windows of the transformer core. Such transformers also have inherent inefficiencies due to flux leakage caused by the exposed, dead end nature of the core and the end windows having only a single oscillating flux path.

SUMMARY OF THE INVENTION

It is an object of the present invention to provide a transformer core and an associated transformer that attempts to alleviate at least the abovementioned problems in the prior art.

According to a first aspect of the invention there is provided a core for a multi-phase transformer. The core includes a body made of two or more rings having a common central axis, each ring consisting of a strip of magnetic permeable material wound about the central axis. The body is provided with a plurality of windows passing radially through the body, each window bound by opposed axially extending legs and opposed circumferentially extending branches, wherein said branches of each window are provided in respective axially adjacent rings. The branches and legs of each window define a closed magnetic circuit about which magnetic flux can circulate.

The core includes a plurality of primary windings. At least one primary winding is provided for each electrical phase, each primary winding having at least one turn wound directly about a branch or a leg of a corresponding window. This produces the magnetic flux that circulates about the corresponding window or about a periphery of an ensemble of the corresponding window and one or more sequentially adjacent windows.

Preferably at least one of said primary windings is wholly wound about one or both branches of said corresponding window.

Preferably at least one of said primary windings is wholly wound about one or both legs of said corresponding window.

Preferably at least one of said primary windings has a plurality of turns wherein at least one of said turns is wound about one branch of said corresponding window and at least one turn is wound about one leg of said corresponding window.

According to a further aspect of the invention there is provided a multi-phase transformer including at least:

a core according to the first aspect of this invention;

a plurality of primary windings, one primary winding being provided for each electrical phase of said transformer; and, a plurality of secondary windings;

each primary winding having at least one turn wound directly about a branch or a leg of a corresponding window to produce lines of magnetic flux which circulate about said corresponding window; and, at least one of said secondary windings having at least one turn wound directly about a branch or a leg of a window about which said lines of magnetic flux circulate to induce the current in said at least one secondary winding.

Preferably at least one primary winding is wound directly about at one or both branches of one window, and at least one secondary winding is wound directly about one or both branches of said one window.

Preferably at least one primary winding is wound directly about one or both branches of one window, and at least one secondary winding is wound directly about one or both legs of said one window.

Preferably at least one primary winding is wound directly about one or both branches of one window, and at least one secondary winding is wound directly about at least one branch and at least one leg of said one window.

Preferably at least one primary winding is wound directly about one or both branches of one window, and at least one secondary winding is wound directly about a branch or a leg of said one window, and directly about a branch or a leg of another window.

Preferably at least one primary winding is wound directly about one or both legs of one window, and at least one secondary winding is wound directly about one or both branches of said one window.

Preferably at least one primary winding is wound directly about one or both legs of one window, and at least one secondary winding is wound directly about one or both legs of said one window.

Preferably at least one primary winding is wound directly about one or both legs of one window, and at least one secondary winding is wound directly about at least one branch and at least one leg of said one window.

Preferably at least one primary winding is wound directly about one or both legs of a window, and at least one secondary winding is wound directly about at least one branch or one leg of said one window, and about at least one branch or one leg of another window.

Preferably at least one primary winding is wound directly about at least one branch and at least one leg of one window, and at least one secondary winding is wound directly about a branch or a leg of said one window.

Preferably at least one primary winding is wound directly about at least one branch and at least one leg of one window, and at least one secondary winding is wound directly about at least one branch and at least one leg of said one window.

The core includes a plurality of primary windings. At least one primary winding is provided for each electrical phase, each primary winding having at least one turn wound directly about a branch or leg of a corresponding window. This produces the magnetic flux that circulates about the corresponding window or about a periphery of an ensemble of the corresponding window and one more sequentially adjacent windows.

Preferably the core includes a plurality of primary windings, one primary winding provided for each electrical phase, each primary winding having at least one turn wound directly about a branch or a leg of a corresponding window.

Preferably the radially opposite branches of each window are configured to have the same volume of magnetically permeable material.

The invention also provides a method of constructing a core according to the first aspect of this invention, said method including the steps of stamping and winding about said central axis a strip of magnetically permeable material to form said body, said stamping arranged to produce said plurality of windows passing radially through said body.

Preferably the method includes the step of splitting said core through a plane passing through said windows.

The invention also provides a method of constructing a core according to the first aspect of this invention, said method including the steps of stamping strips of magnetically permeable material to form respective rings, aligning said rings along said common central axis, said stamping and aligning arranged to produce said plurality of windows.

The invention also provides a method of constructing a core according to the first aspect of this invention, said method including the steps of continuous winding about said central axis a strip of magnetically permeable material to form said body; and machining, cutting or otherwise forming said plurality of windows radially through said body.

Preferably the method includes the step of splitting said core through a plane passing through said windows.

Preferably the method includes the step of loading a prewound bobbin on one or more legs of said core.

The invention also provides a method of constructing a core according to the first aspect of this invention, said method including the steps of continuous winding strips of magnetically permeable material to form respective rings, and machining or forming said plurality of windows radially through respective rings of said body, aligning said rings along said common central axis to form said body, said machining and aligning arranged to produce said plurality of windows.

The invention also provides a method of constructing a core according to the first aspect of this invention, said method including the steps of continuous winding strips of magnetically permeable material to form respective rings, aligning said rings along said common central axis to form said body, said rings being spaced apart by an array of legs to form a plurality of windows passing radially through said body, wherein said branches of each window are provided in respective axially adjacent rings.

BRIEF DESCRIPTION OF THE DRAWINGS

Embodiments of the present invention will now be described by way of example only with reference to the accompanying drawings in which.

According to another aspect of the invention, there is provided a core for a multi-phase transformer. The core includes a body made of two or more rings having a common central axis. Each ring consists of a strip of magnetic permeable material wound about a central axis for one or more turns forming radially stacked laminations co-axial with the axis. The body has a plurality of windows passing radially through the body, each window bound by opposed axially extending legs and opposed circumferentially extending branches. The branches and legs of each window define a closed magnetic circuit through which magnetic flux can circulate about the windows.

The core includes a plurality of primary windings. At least one primary winding is provided for each electrical phase, each primary winding having at least one turn wound directly about a branch or a leg of a corresponding window. This produces the magnetic flux that circulates about the corresponding window or about a periphery of an ensemble of the corresponding window and one or more sequentially adjacent windows.

Figure 3:
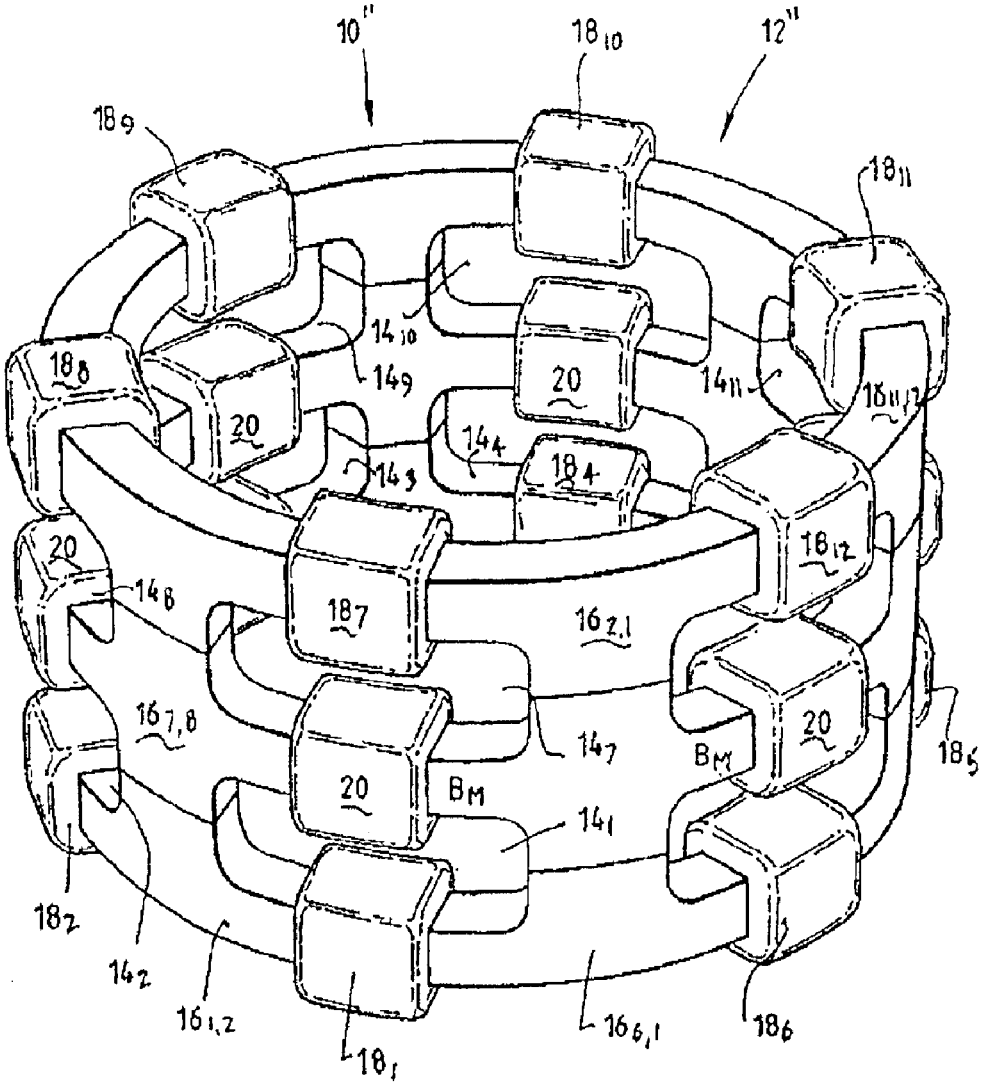

FIG. 3 is a perspective view of a third embodiment of the core in accordance with the present invention.

Figure 4:
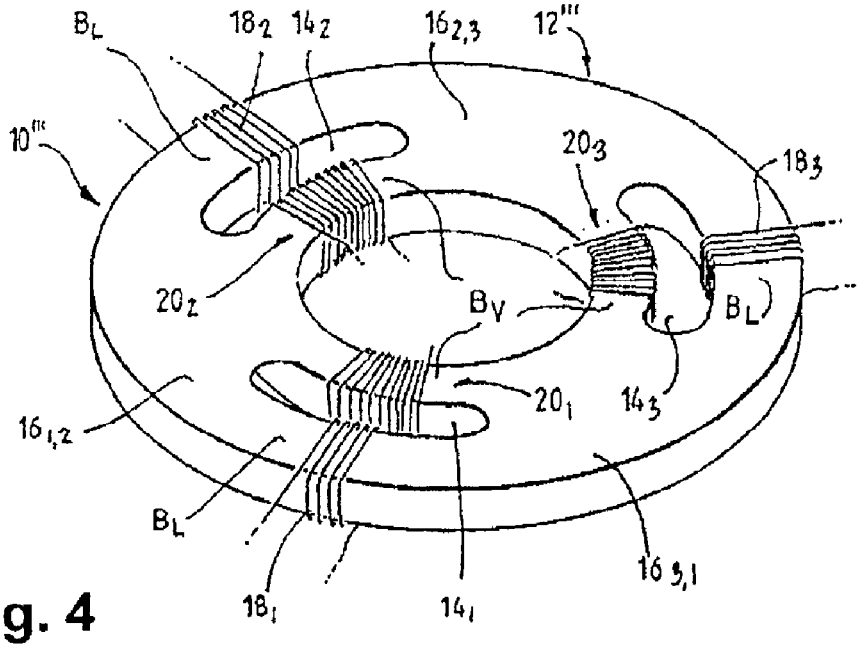

FIG. 4 is a perspective view of a fourth embodiment of the core.

Figure 5:
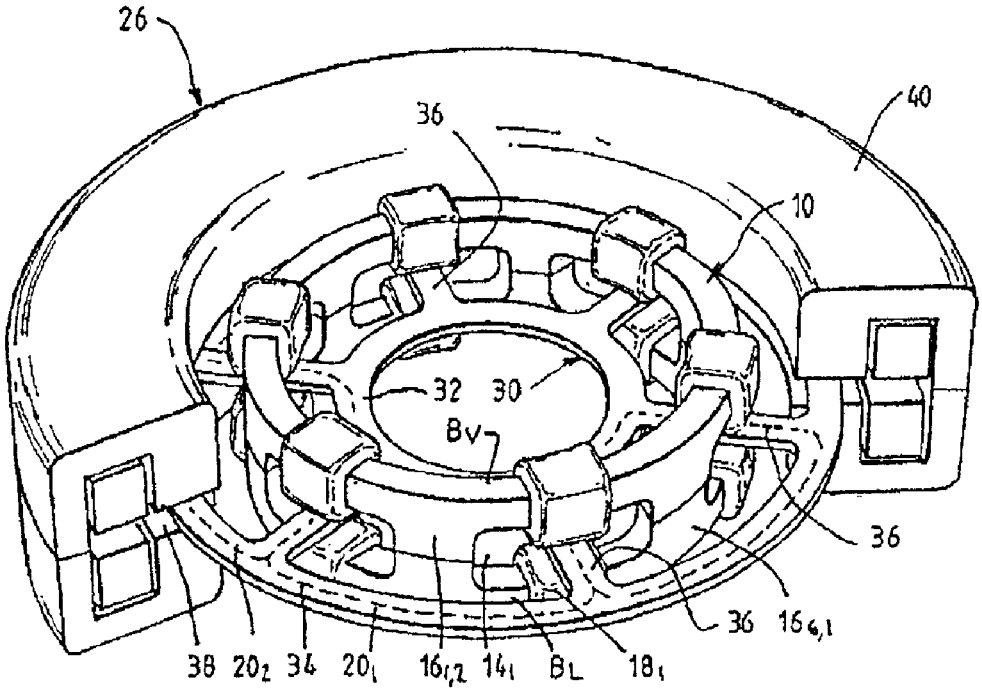

FIG. 5 is a cutaway perspective view of an electric motor incorporating a core in accordance with the present invention.

Figure 6:
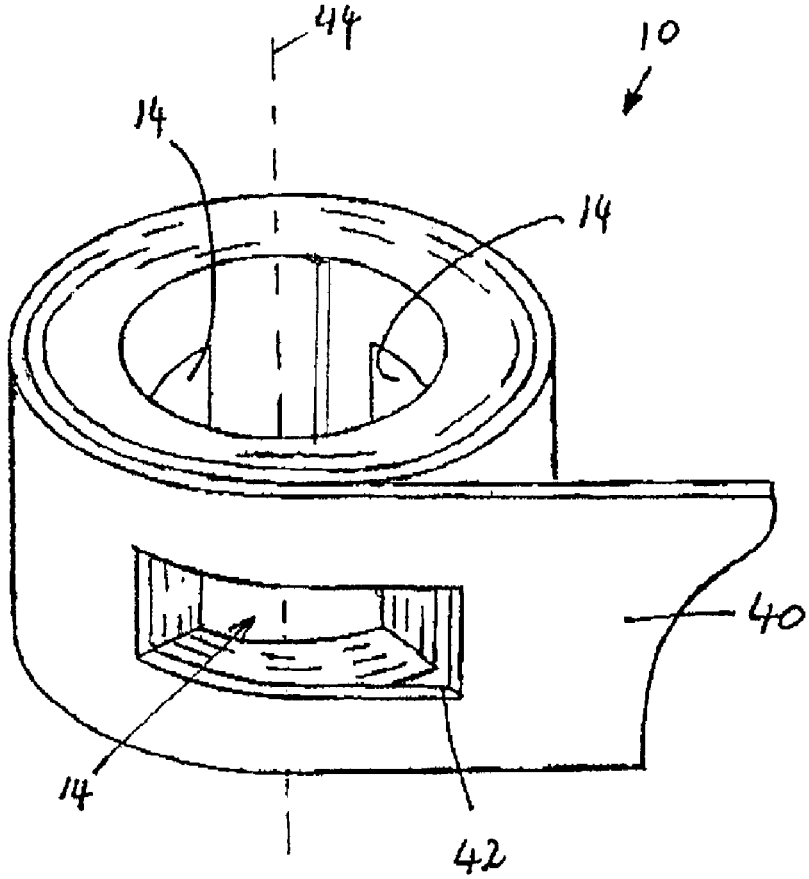

FIG. 6 illustrates one method of manufacture of a core in accordance with the present invention.

Figure 7:
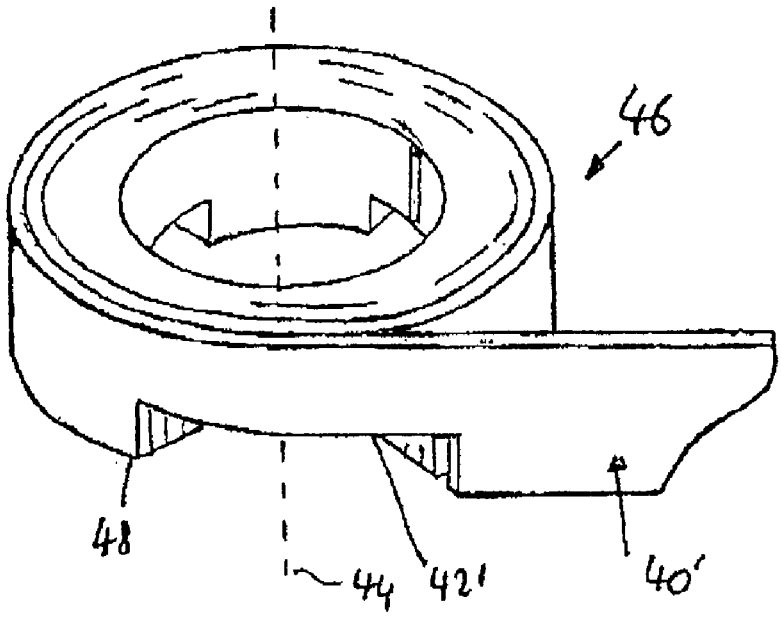

FIG. 7 illustrates another method of manufacture of the core.

Figure 8:
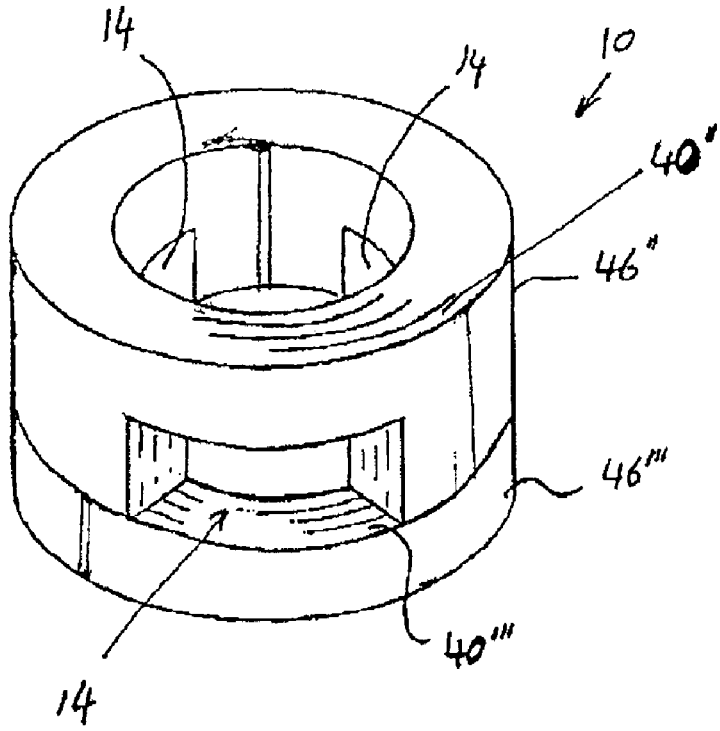

FIG. 8 illustrates another method of manufacture of the core.

Figure 9:
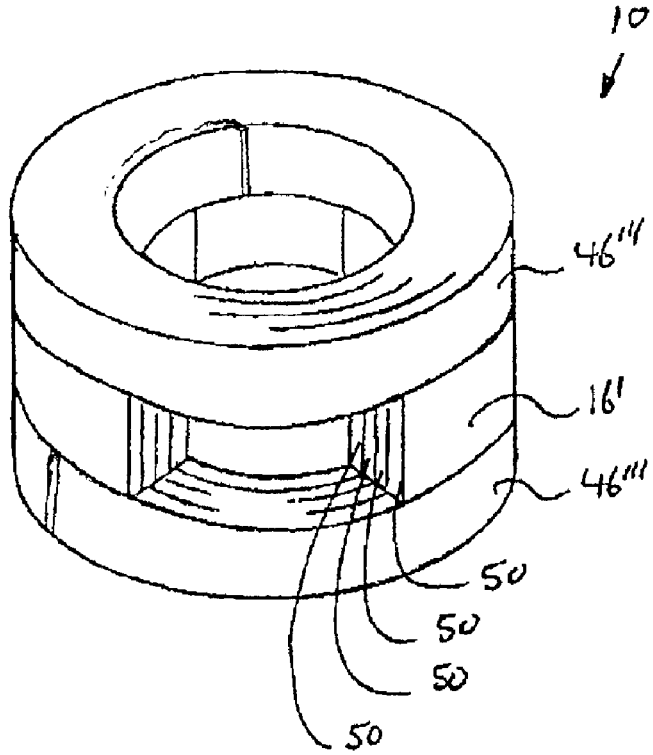

FIG. 9 illustrates another method of manufacture of the core.

Figure 10:
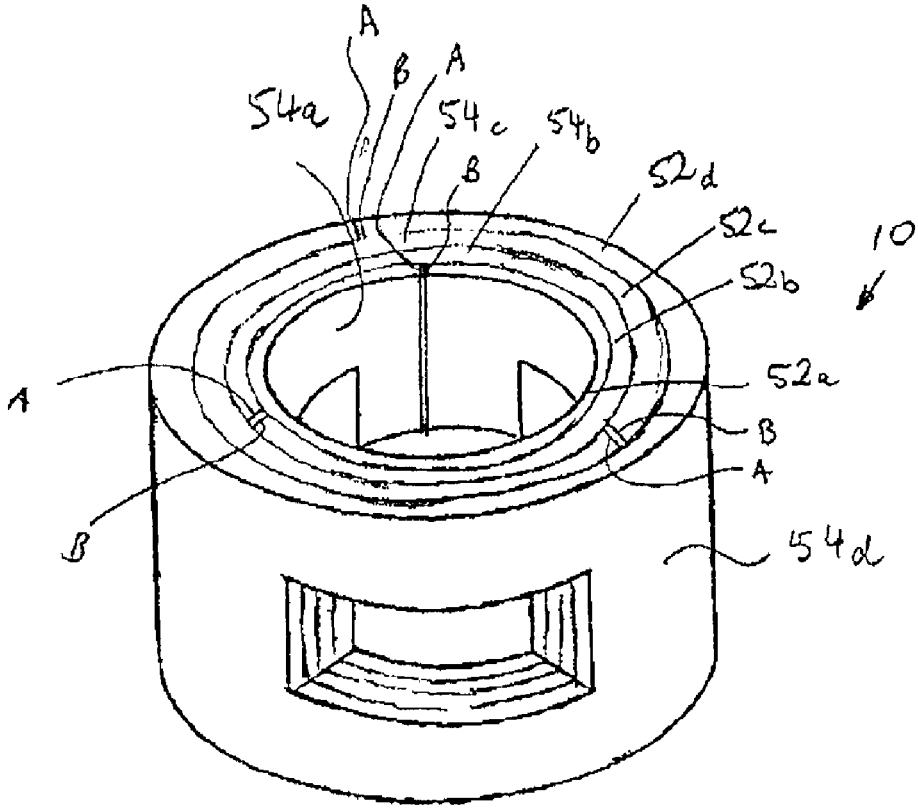

FIG. 10 illustrates another method of manufacture of the core.

DETAILED DESCRIPTION

Figure 1:
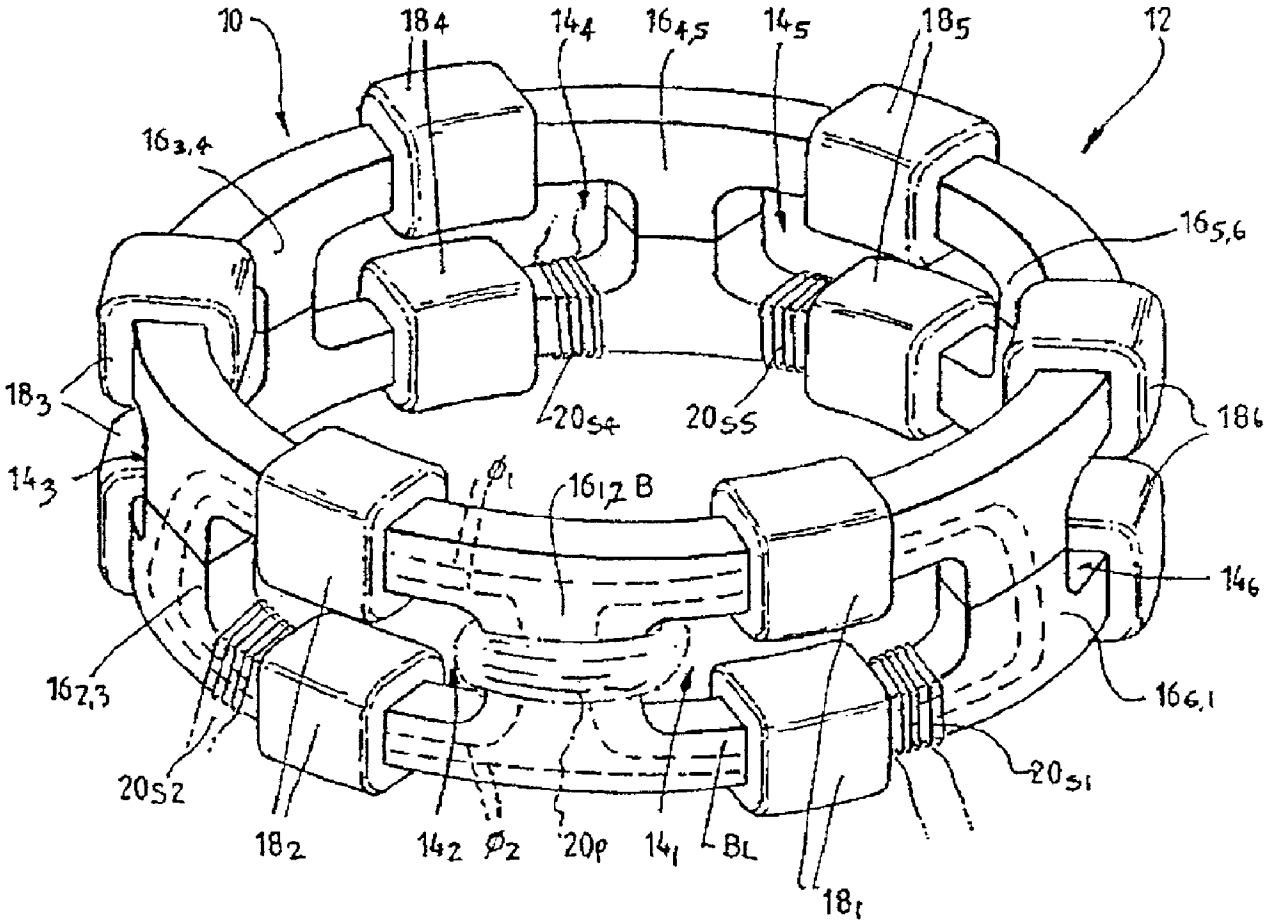
FIG. 1 is a perspective view of a core in accordance with the present invention and a six phase transformer incorporating that core.

Referring to FIG. 1, there is illustrated a core 10 for a multiphase (in this example, six phase) transformer 12. The core 10 is in the general form of an annulus. A plurality of windows $\mathbf{14}_1$–$\mathbf{14}_6$ (referred to in general as windows $\mathbf{14}_i$) are formed through and about the core 10. Adjacent windows $\mathbf{14}_i$ share a common portion or leg $\mathbf{16}_{i,j}$ where $_i$ and $_j$ designate the adjacent windows. For example, leg $\mathbf{16}_{1,2}$ is the portion of core 10 between adjacent windows $\mathbf{14}_1$ and $14_2$; and leg $16_{4,5}$ is the portion or leg of core 10 between adjacent windows $14_4$ and $14_5$. Due to the configuration of the core 10, there are no dead ends in so far as magnetic flux is concerned and therefore the core 10 facilitates the existence of symmetrical magnetic flux through the core 10.

Each window $14_i$ is bound on opposite sides by the adjacent, core portions or legs $16_{i,j}$ and, by upper and lower branches $B_u$ and $B_l$. Thus, for example window $14_1$ is bound on the left side by common core portion $16_{1,2}$; on the right side by common core portion $16_{6,1}$; upper branch $B_u$; and, lower branch $B_l$.

Multiphase transformer 12 is constructed by winding respective primary and secondary windings through the windows $14_i$. In the embodiment shown, primary windings $18_1$ and $18_6$ (referred to in general as primary windings $18_i$) link with respective windows $14_i$. More particularly, two primary windings $18_i$ (of the same phase) are provided for each window $14_i$, with one primary winding about the upper branch $B_u$ and another primary winding about a lower branch $B_l$ of each window $14_i$.For example, looking at window $14_1$ a pair of primary windings $18_1$ is provided, one of each formed about the upper branch $B_u$ and lower branch $B_l$ of the window $14_1$.

When the primary windings $18_i$ are coupled to respective phases of a six-phase AC power supply lines of magnetic flux $\phi_i$ are generated and circulate about at least the window through which the primary winding $18_i$ is wound. Again taking for example window $14_1$ when the primary windings $18_1$ are connected to one phase of the six-phase AC power supply, lines of magnetic flux $\phi_1$ are generated that circulate about window $14_1$. However, it must be appreciated that the magnetic flux generated can also circulate or return about other windows $14_i$. Thus a part of the magnetic flux $\phi_1$ can circulate about both windows $14_1$ and $14_2$ returning through legs $16_{2,3}$ and $16_{6,1}$ and circulate about windows $14_1$, $14_2$ and $14_6$ returning via legs $16_{2,3}$ and $16_{5,6}$.

The placement of secondary windings through the windows $14_i$ is dependent upon the desired output. If it is desired that the phase of the output from the secondary windings is to be the same as the phase of the corresponding primary winding then secondary windings $20_{s1}$–$20_{s6}$ can be wound for example about the lower branch $B_l$ of each window $14_1$–$14_6$ respectively. (Of course in a variation, the secondary windings $20_{s1}$–$20_{s6}$ can be placed about the upper branches $B_u$ of each window or even alternate between the upper and lower branches.) It will be appreciated that because of the symmetric distribution of magnetic flux $\phi_i$ about each of the windows $14_i$, assuming that the primary voltage for each phase is of the same magnitude, the magnitude of the voltage output from the secondary windings $20_{si}$ will be the same if each of the secondary windings $20_{si}$ have the same number of turns. Thus, the core 10 and transformer 12 provide the ability to have secondary output of equal magnitude where the secondary windings $20_{s1}$–$20_{s6}$ have the same number of turns. As discussed above in relation to the prior art, because of the inherent magnetic imbalance of known cores and transformers, in order to have secondary outputs of equal magnitude in a multiphase transformer one must deliberately design some of the coils to have different number of turns.

The core 10 and transformer 12 also allow for an infinite possibility of phase shifting or combining. If one wanted to obtain a secondary output of a phase halfway between the phases of say the primary voltages supplying primary windings $18_1$ and $18_2$ then a secondary winding $20_p$ (shown in phantom) can be wound through both windows $14_1$ and $14_2$ i.e. about the common core portion $16_{1,2}$. Now, the second winding $20_p$ links with the magnetic flux $\phi_1$ and $\phi_2$ and thus the secondary output is of a magnitude and phase corresponding to the vector or phasor addition of the voltage induced by fluxes $\phi_1$ and $\phi_2$. This provides a 1:1 transformed combination of the phases feeding primary windings $18_1$ and $18_2$. However combinations of other ratios and thus different amounts of phase shifting can be achieved at will by simply winding the secondary winding $20_p$ about the upper or lower branches $B_u$, $B_l$ or common core portions $16_{i,j}$ of different windows. For example, in the embodiment shown in FIG. 1, the primary phases are 60° apart. To obtain a secondary output having a phase 15° (i.e. ¼ the phase difference) in advance of the phase of the primary voltage feeding primary winding $18_1$ a secondary winding (not shown) is provided having a 1:4 turn ratio about branch $B_l$ of window $14_1$ and branch $B_l$ of window $14_2$, i.e. the secondary winding has four turns passing through window $14_2$ for every turn passing through window $14_1$.

Figure 2:
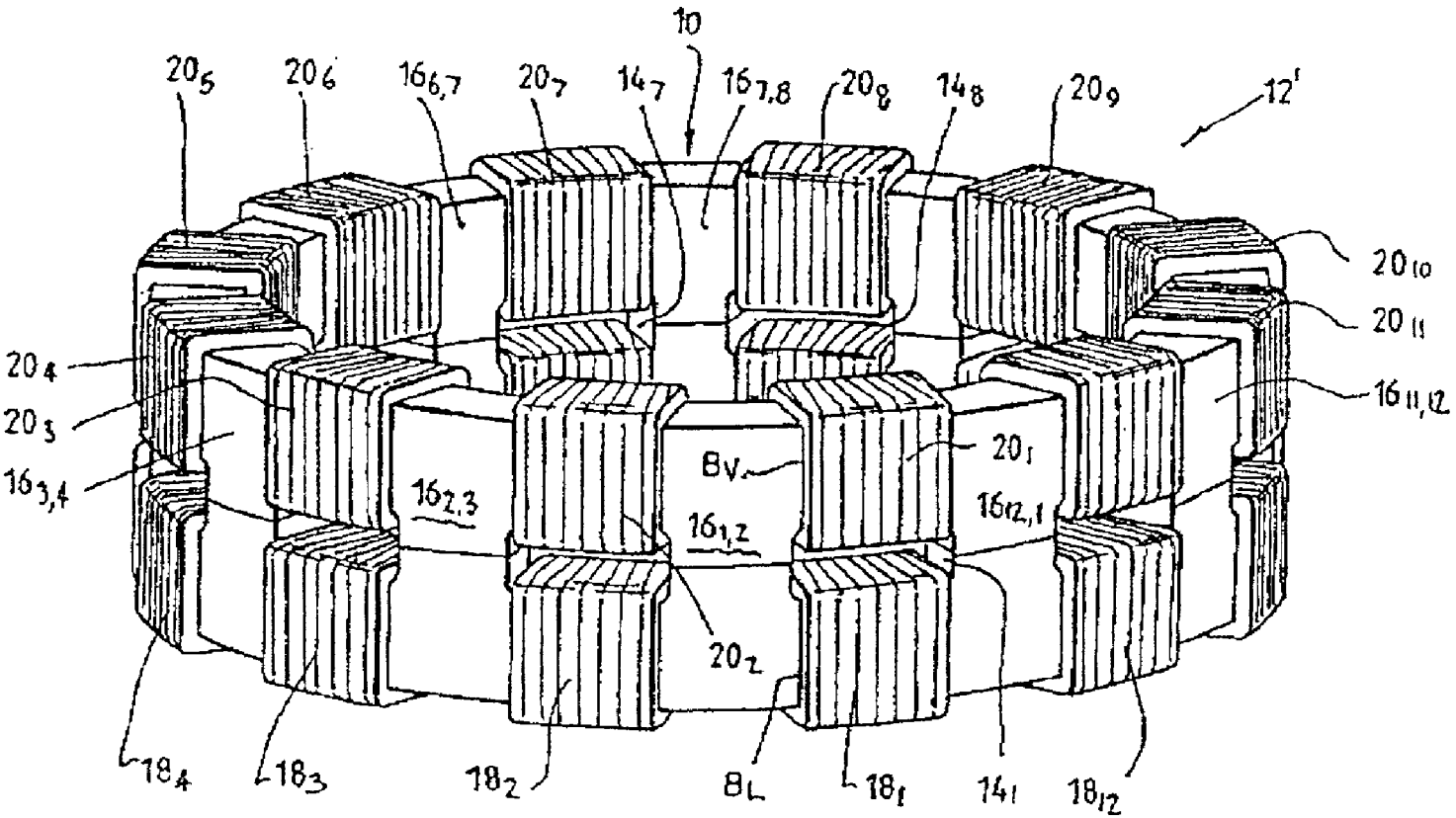
FIG. 2 is a perspective view of a second embodiment of the core and a 12 phase transformer incorporating that core.

FIG. 2 illustrates a core 10' suitable for constructing a twelve phase transformer 12'. Here, the core 10' is again in shape of a ring or annulus but this time provided with twelve windows $14_1$–$14_{1,2}$ and twelve common core portions $16_{i,j}$, one of each between respective adjacent windows $14_i$. A primary winding $18_i$ is wound about lower branch $B_l$ of each window $14_i$. A secondary winding $20_i$ is wound about the upper branch $B_u$ of each window $14_i$. The phase of the output of any secondary winding $20_i$ is the same as the phase of voltage driving the corresponding primary winding $18_i$. However, as with the previous embodiment, the secondary winding $20_i$ can be wound partially about the upper and lower branches $B_u$ and $B_l$ or common core portions $16_{i,j}$ of different windows in any desired combination to produce a desired phase output in accordance with standard transformer design techniques.

FIG. 3 illustrates an extending (vertically stacked) core 10" and a multiphase transformer 12" constructed using the core 10". The core 10" can be considered as being two six window cores vertically stacked upon each other. Thus the core 10" has a lower set of windows $14_1$–$14_6$ and an upper set of windows $14_7$–$14_{12}$ with windows $14_i$ and $14_{i+6}$ in vertical alignment. Primary windings $18_1$–$18_6$ are wound about the lower branches $B_l$ of windows $14_1$–$14_6$ respectively; and, primary windings $18_7$–$18_{1,2}$ are wound about the upper branches $B_l$ of the upper set of windows $14_7$–$14_{1,2}$. A set of secondary windings 20 are wound about the middle branch $B_m$ between vertically adjacent windows $14_i$, $14_{i+6}$. Therefore, in this particular illustrated embodiment, there are only six secondary coils 20. The output of any particular secondary winding 20 would be the transformed phasor or vector addition of voltages induced by the magnetic flux generated by the primary windings linked with the windows common to that particular secondary winding 20. In order to avoid saturation it is preferred that the volume of core constituting the middle branch $B_m$ is the sum of the volume of the core constituting the lower branch $B_l$ and upper branch $B_u$ of the windows $14_i$, $14_{i+6}$. This embodiment then allows the combination of two six phase supplies that are out of phase with each other. For example, if there are two six phase power supplies, one providing input to coils $18_1$–$18_6$ and another providing input to primary windings $18_7$–$18_{1,2}$, the two power sources can be combined to provide a six phase output through the secondary windings 20. This could be particularly useful in for example coupling two multiple phase power supplies to a common power transmission grid. The core configuration will also allow for the ability to have 6 primary and 12 secondary windings. Also a turns ratio of 1/0.5 primary to secondary, or secondary to primary, as well as incorporating other windows will produce any fraction of volts required.

In a different configuration (not illustrated) the primary windings $\mathbf{18}_1$–$\mathbf{18}_{1,2}$ of transformer 12" can be connected to a different phase of a twelve phase power supply and primary windings 20 round through various windows $\mathbf{14}_i$ to provide a transformed twelve phase output. Again, the phasing of the output from the secondary windings can be arranged as required in accordance with known transformer design techniques to provide the desired secondary phase output.

FIG. 4 further illustrates a further embodiment of the core 10'" and a corresponding 12'". In the embodiments shown in FIGS. 1–3 the core 10 and windows $\mathbf{14}_i$ extend perpendicular to the axis of the core 10. That is the windows $\mathbf{14}_i$ are formed through the radial direction of the core. With the core 10'" of FIG. 4, the axis of the core 10 is parallel with the axis of any window $\mathbf{14}_i$. As with all previous embodiments, core 10'" is configured in the general form of an annulus or ring having a plurality of windows $\mathbf{14}_i$ where adjacent windows share a common portion of core $\mathbf{16}_{i,j}$ so that they number of windows $\mathbf{14}_i$ equals the number of common core portions $\mathbf{16}_{i,j}$. More specifically, three windows $\mathbf{14}_1$–$\mathbf{14}_3$ are formed in the core 10'" with a primary winding $\mathbf{18}_1$–$\mathbf{18}_3$ respectively wound about the lower (radially outer most) branches $B_l$ of each window $\mathbf{14}_i$. Respective secondary windings $\mathbf{20}_1$–$\mathbf{20}_3$ are wound through the windows $\mathbf{14}_1$–$\mathbf{14}_3$ respectively about the corresponding upper (radially inner most) branches $B_u$. It is preferred that the core 10'" is configured so that the volume of core in the upper and lower branch portions $B_l$, $B_u$ of each window $\mathbf{14}_i$ is the same. This assists in avoiding saturation of the core. This can be achieved by appropriate placement or configuration of the windows $\mathbf{14}_i$. The core 10'" is depicted as a disc having a relatively small axial length in comparison to its radius. However it may of course be formed with an axial length exceeding the length of its radius.

FIG. 5 illustrates an application of the core 10 shown in FIG. 1. The core 10 is used in this application in a transverse flux motor 26. Full operation and constructional details of the transverse flux motor are described in the Applicant's Australian Application No PP 7124 the contents of which is incorporated herein by way of reference. The structure of core 10 and the placement of primary windings $\mathbf{18}_1$–$\mathbf{18}_6$ is identical to that described in the first embodiment described in relation to FIG. 1. However, instead of multi turn electrically separate secondary windings a single turn secondary winding between $\mathbf{20}_i$ is provided about each common core portion $\mathbf{16}_{i,j}$ with each of the single turn secondary windings $\mathbf{20}_i$ being in mutual electrical connection. Thus, the single turn secondary windings $\mathbf{20}_1$–$\mathbf{20}_6$ form a wheel like structure 30 having an inner rim 32 and outer rim 34 joined by radially extending spokes 36. The outer rim 34 is depicted as residing in the air gap 38 of a cockcroft ring 40. Without going into the detail of operation of the motor 26, currents are induced through the single turn secondary windings $\mathbf{20}_1$–$\mathbf{20}_6$ that interact with magnetic flux passing through the air gap 38 of the cockcroft ring 40 thereby generating transverse forces on the outer rim 34 of the wheel 30 causing it to move. The path of motion of the wheel 30 can be controlled at will by variation of the magnitude and frequency of the primary voltages supplied to the primary coil $\mathbf{18}_1$–$\mathbf{18}_6$ and the phase relationship therebetween.

Now that embodiments of the present invention have been described in detail it will be apparent to those skilled in the relevant arts and numerous modifications and variations may be made without departing from the basic inventive concepts. For example, in each of the embodiments shown, the core 10 is depicted essentially as being in a ring, annulus or circular type form. However it can assume other shapes provided that it is continuous or endless and is provided with equal numbers of windows and common core portions. Also, the exact number of windows provided is simply dependent upon the application and in particular the number of primary phases. Also, the position and placement of the secondary windings $\mathbf{20}_i$ is dictated solely by the desired magnitude and phase of the secondary outputs.

The core 10, 10', 10", 10'" can be made by casting; continuous stamping and winding of an strip of magnetically permeable material; winding of a strip of material then machining/cutting the windows. Naturally, the strip is wound so that its width extends in the direction of the axis of the core. The manufacture of the core by winding of a strip of material is depicted in FIGS. 6–9. With particular reference to FIG. 6, a strip of magnetically permeable material 40, stamped with rectangular cutouts 42 is wound about an axis 44 to produce a core 10. The cutouts 42 are disposed within the periphery of the strip 40 and align circumferentially to produce windows 14.

Further the core can be split through a plane passing through the windows 14 to facilitate mechanical/automatic winding of the primary and/or secondary windings about the window branches $B_u$, $B_1$, or loading of prewound bobbins on the common core portions $\mathbf{16}_{i,j}$. The splitting can be effected after winding of the strip, or alternately the core can be initially formed as a split core, i.e. from two separate strips which are wound to form respective rings or loops which can be aligned along a common axis to form the core. This is depicted in FIGS. 7 and 8. In FIG. 8, one (of two) rings or loops 46 is shown being formed by winding of a strip 40' about an axis 44. The strip 40' is provided with cutouts 42' which open onto one edge 48 of the strip 40'. By axially aligning two rings or loops 46 with respective edges 48 and cutouts 46' facing each other, a core is produced. The facing cutouts 46' form windows 14 and the formed core is effectively split in a plane passing centrally through the windows 14.

The stamping is for the purpose of producing the windows. If desired when producing the core from separate axially aligned rings or loops, the stamping could be performed on the strips used to form one of the rings or loops only with the full length of the legs provided on that one ring or loop. Thus the one ring or loop provides one branch and two legs of each window 14. Then a second non-stamp ring or loop can be axially aligned and abutted with the previous ring or loop to provide a second branch for each window. This arrangement is depicted in FIG. 8 where two loops 46" and 46'" are wound from respective strips 40" and 40'". The strip 40" is provided with cutouts 42" which open onto edge 48 and include the full length of the legs 16 of the windows 14 of the final assembled core 10. The strip 40'" forming the ring 46'" has no cutouts as is simply axially aligned with and abutted against edge 48 of ring 46" to form the core 10.

The strip can of course be wound for more than 360° as shown most clearly in FIG. 6. In this event it would be preferable to form the windows 14 after winding of the strip by appropriate machining techniques such as laser, wire or water cutting, spark erosion, grinding or milling. Stamping could still be used although the stamping would need to be incremental or indexed to take into account the change in diameter to ensure correct circumferential alignment of the voids left by the stamping to create the windows. When wound for more than 360° it is preferable for the strip to be insulated to reduce the effects of eddy currents in adjacent windings of the strip. This can be achieved with known techniques such as applying a layer of varnish to the strip.

In a further method of construction separate rings or loops can be formed by continuous winding of strips of magnetically permeable material with the rings or loops forming the branches only of the windows and forming the legs separately which are disposed between axially aligned rings or loops. The legs can be formed from the same material as the rings or loops as separate stacked short lengths which are bound or otherwise held together. Thus the axial ends of the separate lengths abut individual turns of the strips forming the rings or loops. In this way a closed magnetic circuit is maintained about each window and each turn or layer constituting each window. This arrangement is shown in FIG. 9 where the core 10 is formed by two rings 46''' separated by separate intervening legs 16'. Each ring is formed by winding a plain strip of material having no cutouts. The legs 16' are formed from individual curved plates 50 of material of the same thickness of the strips used for winding the rings 46'''. The number of plates 50 used to form each leg is equal to the number of turns of the strip in each ring 46'''.

In yet a further variation in the method of manufacture, instead of winding a single strip as described in relation to FIGS. 6–9 a plurality of individual strips could be wound into individual rings with adjacent/abutting ends and axially stacked one inside the other to produce a core. This is depicted in FIG. 10 which illustrates a core 10 made form four strips 52*a*–52*d* of material each of which is wound for approximately 360° only about an axis to form corresponding rings 54*a*–54*d*. The successively outer rings have greater diameter. Each strip 52*a*–52*d* is prior stamped to produce rectangular cutouts 42 which radially align to form windows 14. Due to the change in diameter of successive rings 54 the spacing of the cutouts needs to be indexed or incremented from ring to ring. Clamps 56 may be applied about the core 10 to hold the rings 54 together and ensure that the opposite ends A and B of each ring are closely adjacent each other or abutting. Preferably the ends A and B of the ring are staggered or offset about the core. All of the manufacturing methods described in relation to FIGS. 6–9 can be replicated with individual rings of the type described above in relation to FIG. 10, e.g. the rings 46, 46', 46" and 46''' of FIGS. 6–9 can be formed of concentric separate rings stacked inside each other with closely adjacent/abutting ends A, B.

All such variations and modifications together with others that would be obvious to a person of ordinary skill in the art are deemed to be within the scope of the present invention the nature of which is to be determined from the a foregoing description.

What is claimed is:

1. A core for a multi-phase transformer, said core including a body made of two or more rings having a common central axis, each ring consisting of a strip of magnetic permeable material wound about said central axis, said body provided with a plurality of windows passing radially through said body, each window bound by opposed axially extending legs and opposed circumferentially extending branches, wherein said branches of each window are provided in respective axially adjacent rings, said branches and legs of each window defining a closed magnetic circuit about which magnetic flux can circulate; and a plurality of primary windings, at least one primary winding provided for each electrical phase, each primary winding having at least one turn wound directly about a branch or a leg of a corresponding window producing the magnetic flux that circulates about the corresponding window or about a periphery of an ensemble of the corresponding window and one or more sequentially adjacent windows.

2. The core according to claim 1 wherein at least one of said primary windings is wholly wound about one or both branches of said corresponding window.

3. The core according to claim 1 wherein at least one of said primary windings is wholly wound about one or both legs of said corresponding window.

4. The core according to claim 1 wherein at least one of said primary windings has a plurality of turns wherein at least one of said turns is wound about one branch of said corresponding window and at least one turn as wound about one leg of said corresponding window.

5. A multi-phase transformer comprising:

a core according to claim 1;

a plurality of secondary windings;

at least one of said secondary windings having at least one turn wound directly about a branch or a leg of a window about which said lines of magnetic flux circulate to induce the current in said at least one secondary winding.

6. The transformer according to claim 5 wherein at least one primary winding is wound directly about at one or both branches of one window, and at least one secondary winding is wound directly about one or both branches of said one window.

7. The transformer according to claim 5 wherein at least one primary winding is wound directly about one or both branches of one window, and at least one secondary winding is wound directly about one or both legs of said one window.

8. The transformer according to claim 5 wherein at least one primary winding is wound directly about one or both branches of one window, and at least one secondary winding is wound directly about at least one branch and at least one leg of said one window.

9. The transformer according to claim 5 wherein at least one primary winding is wound directly about one or both branches of one window, and at least one secondary winding is wound directly about a branch or a leg of said one window, and directly about a branch or a leg of another window.

10. The transformer according to claim 5 wherein at least one primary winding is wound directly about one or both legs of one window, and at least one secondary winding is wound directly about one or both branches of said one window.

11. The transformer according to claim 5 wherein at least one primary winding is wound directly about one or both legs of one window, and at least one secondary winding is wound directly about one or both legs of said one window.

12. The transformer according to claim 5 wherein at least one primary winding is wound directly about one or both legs of one window and at least one secondary winding is wound directly about at least one branch and at least one leg of said one window.

13. The transformer according to claim 5 wherein at least one primary winding is wound directly about one or both legs of a window, and at least one secondary winding is wound directly about at least one branch or one leg of said one window, and about at least one branch or one leg of another window.

14. The transformer according to claim 5 wherein at least one primary winding is wound directly about at least one branch and at least one leg of one window, and at least one secondary winding is wound directly about a branch or a leg of said one window.

15. The transformer according to claim 5 wherein at least one primary winding is wound directly about at least one branch and at least one leg of one window, and at least one secondary winding is wound directly about at least one branch and at least one leg of said one window.

16. A method of constructing a core according to claim 1, said method including the steps of stamping and winding about said central axis a strip of magnetically permeable material to form said body, said stamping arranged to produce said plurality of windows passing radially through said body.

17. The method according to claim 16 including the step of splitting said core through a plane passing through said windows.

18. A method of constructing a core according to claim 1, said method including the steps of stamping strips of magnetically permeable material to form respective rings, aligning said rings along said common central axis, said stamping and aligning arranged to produce said plurality of windows.

19. A method of constructing a core according to claim 1, said method including the steps of continuous winding about said central axis a strip of magnetically permeable material to form said body; and machining, cutting or otherwise forming said plurality of windows radially through said body.

20. The method according to claim 19 including the step of splitting said core through a plane passing through said windows.

21. The method according to claim 17 including the step of loading a prewound bobbin on one or more legs of said core.

22. The method according to claim 18 including the step of loading a prewound bobbin on one or more legs of said core.

23. The method according to claim 20 including the step of loading a prewound bobbin on one or more legs of said core.

24. A method of constructing a core according to claim 1, said method including the steps of continuous winding strips of magnetically permeable material to form respective rings, and machining or forming said plurality of windows radially through respective rings of said body, aligning said rings along said common central axis to form said body, said machining and aligning arranged to produce said plurality of windows.

25. A method of constructing a core according to claim 1, said method including the steps of continuous winding strips of magnetically permeable material to form respective rings, aligning said rings along said common central axis to form said body, said rings being spaced apart by an array of legs to form a plurality of windows passing radially through said body, wherein said branches of each window are provided in respective axially adjacent rings.

26. A core for a multi-phase transformer, said core comprising a body made of two or more rings having a common central axis, each ring consisting of a strip of magnetic permeable material wound about said central axis for one or more turns forming radially stacked laminations co-axial with said axis, said body provided with a plurality of windows passing radially through said body, each window bound by opposed axially extending legs and opposed circumferentially extending branches, wherein said branches and legs of each window defining a closed magnetic circuit through which magnetic flux can circulate about said windows; and a plurality of primary windings, at least one primary winding provided for each electrical phase, each primary winding having at least one turn wound directly about a branch or a leg of a corresponding window producing the magnetic flux that circulates about the corresponding window or about a periphery of an ensemble of the corresponding window and one or more sequentially adjacent windows.

* * * * *